US006702573B2

(12) United States Patent
Massey

(10) Patent No.: US 6,702,573 B2
(45) Date of Patent: Mar. 9, 2004

(54) CANDLE SUPPORT METHOD AND APPARATUS

(76) Inventor: Dean Travis Massey, 526 Candler St., Gainesville, GA (US) 30501

( * ) Notice: Subject to any disclaimer, the term of this patent is extended or adjusted under 35 U.S.C. 154(b) by 0 days.

(21) Appl. No.: 09/900,205

(22) Filed: Jul. 5, 2001

(65) Prior Publication Data

US 2003/0008258 A1 Jan. 9, 2003

(51) Int. Cl.[7] ..... F23D 3/16; F21V 35/00
(52) U.S. Cl. ..... 431/297; 431/296
(58) Field of Search ..... 431/297, 296, 431/295, 289, 288, 126; 361/161

(56) References Cited

U.S. PATENT DOCUMENTS

| | | | | | |
|---|---|---|---|---|---|
| 422,989 | A | * | 3/1890 | Stelzner | 431/297 |
| 441,625 | A | * | 11/1890 | Wohlmuth | 431/297 |
| D72,242 | S | | 3/1927 | Seidel | |
| 2,057,943 | A | | 10/1936 | Friedrichs | |
| 2,393,767 | A | | 1/1946 | Gould | |
| 2,478,864 | A | * | 8/1949 | Dillon et al. | 431/295 |
| 2,527,707 | A | | 10/1950 | Curtis | |
| 2,741,110 | A | * | 4/1956 | Thompson | 431/297 |
| 2,981,087 | A | * | 4/1961 | Pesier | 431/297 |
| D208,517 | S | | 9/1967 | Lustbader | |
| 3,561,683 | A | * | 2/1971 | Dragan | 431/297 |
| 4,028,046 | A | * | 6/1977 | Kilvert | 431/297 |
| 4,036,577 | A | * | 7/1977 | Veitel et al. | 431/297 |
| 5,482,456 | A | | 1/1996 | Jwayad et al. | |
| D371,213 | S | | 6/1996 | Hardy et al. | |
| 5,554,023 | A | | 9/1996 | Pustay | |
| 5,975,889 | A | | 11/1999 | Culpepper | |
| 6,017,011 | A | | 1/2000 | Lee | |
| D427,338 | S | | 6/2000 | Ratia | |

FOREIGN PATENT DOCUMENTS

| | | | | | |
|---|---|---|---|---|---|
| DE | 34 06 525 | A | * | 8/1985 | F21V/35/00 |
| JP | 2002-30831 | A | * | 1/2002 | F21V/35/00 |

* cited by examiner

*Primary Examiner*—Josiah Cocks
(74) *Attorney, Agent, or Firm*—Hinkle & O'Bradovich, LLC

(57) ABSTRACT

A method and apparatus for supporting and controlling a candle in an candelabra and other candle holders is disclosed. A candle support apparatus includes an outer shell or tubular body and inner shell or tubular body. The outer shell is typically a rigid casing that attaches to the candelabra or other candle holder. The inner radius of the outer shell is typically larger than the candle. The inner shell is typically resilient and has a radius smaller than the candle. The inner shell includes a substantially cylindrical portion having a longitudinal axis. The inner shell further includes a number of prongs sharing a common longitudinal axis with the substantially cylindrical portion. The end of the outer shell that is adapted to connect to the candelabra is a closed end with a hole adapted to receive a screw, bolt or other device used to attached the support apparatus to the candelabra. The inner and outer shells are connected to each other by a connecting device such as a rivet that is typically driven through both the inner and outer shell perpendicular to the longitudinal axis.

5 Claims, 7 Drawing Sheets

CANDLE SUPPORT METHOD AND APPARATUS

BACKGROUND OF THE INVENTION

I. Field of the Invention

The present invention relates generally to the field of candles, and more particularly to a method and apparatus for supporting candles in a candle display device.

II. Description of the Related Art

For centuries, candles have been used for a variety of reasons ranging from reading light to decorations at ceremonial events such as weddings. In recent years, mechanical candles have been used to replace the more typical wax candles. In many settings such as churches, wax candles are no longer acceptable because of danger of wax damage to church property as well as increased risk of fire.

FIG. 1A illustrates a prior art mechanical candelabra 100. The candelabra 100 typically includes a base stand 110 connected to a long support pole 105. A candle holder arrangement 120 typically sits atop the pole 105. The candle holder arrangement 120 on top of the pole supports a mechanical candle 125. Braces 115 are typically connected to the pole 105 on the sides. The braces 115 serve both as decoration and support for additional candle holder arrangements 120 which in turn support two additional candles 120. The candelabra 100 is a typical candelabra used for mechanical candles and is shown to illustrate the prior art. There are a variety of other arrangements in the prior art that support mechanical candles.

FIG. 1B illustrates a prior art mechanical candle 125 illustrated in FIG. 1A. The candle 125 typically includes an elongated body 126. At one end of the body a tip 144 includes a replaceable wax insert 135 which can be lit with a flame 140. The elongated body 126 typically includes an outer cover 130 and an internal mechanism (not shown) that supports the wax insert 135. The candle 125 also has a base 145. The base includes a twist portion 150 that is used to removed the outer cover 130 from the internal mechanism (not shown).

FIG. 2 illustrates side view of a candle holder arrangement 200 (120 in FIG. 1A). The arrangement 200 includes a base 205. The base can be decorative adding to the aesthetic beauty of the candelabra. Candle support prongs 215 are connected to support device that is connected to the base 205. Decorative coverings 210 surround the support prongs 215. The support prongs 215 can also be decorative, but function mainly to support a mechanical candle.

FIG. 3A illustrates a side view of a candle holder arrangement 305. This arrangement is similar to the arrangement 200 in FIG. 2. However, the decorative coverings have been removed to better illustrates the candle support device 310. This arrangement 300 also includes a base 305. A mechanical candle 320 is shown supported in the support device 310 by the individual prongs 315. FIG. 3B illustrates the component parts of the holder 300 of FIG. 3A. The support device 310 is connected to the base 305 by a bolt 360 and a nut 355. A hole (not shown) in the device 310 fits onto the bolt 360 and the nut 355 is screwed onto the bolt 360 to support the device 310. FIG. 3C illustrates a top view of the candle holder 300. The device 310 is connected to the base 305 and the nut 355 is screwed onto the bolt 360. The support devices 310 are typically manufactured of rigid plastic or metal.

FIG. 4 illustrates a candle support arrangement 400. The arrangement includes a base 405 decorative coverings and support prongs 415 similar to the figures described above. Over time, the prongs 415 can become weak in many ways. For example, plastic or metal can become fatigued and break or simply bend out of place. When the prongs 415 weaken, the mechanical candle 420 begins to fall to off to one side and has to be straightened. FIG. 4B illustrates an candelabra 450 having three candles 460, 465, 470. Candle 460 is substantially straight. Candle 465 is offset in the direction of arrow 466 and candle 470 is offset in a direction of arrow 471. Typically, the candles, now offset from the normal center position interfere with the ceremony and service providers in the ceremony. Typically, photographers have to deal with the crooked candles, often stopping a picture in order to straighten the candle. Once a candle is straightened there is no guarantee that it won't fall off center again because the candle is simply balanced into a straightened position.

If the device and prongs 415 are made of metal, the decorative covering 410 can be removed and the prongs 415 can be bent back into shape. If the prongs 415 are plastic, the entire device needs to typically be replaced.

SUMMARY OF THE INVENTION

In accordance with the present invention and the contemplated problems which have and continue to exist in this field, the invention features a method and apparatus for securing candles in candle display devices such as candelabras and candlesticks. The candle support apparatus replaces the prior art prongs and is typically more durable and long lasting. The candle support apparatus supports and straightens a candle once the candle is inserted and typically requires no further attention to maintain the supported candle.

A candle support apparatus includes an outer shell or tubular body and inner shell or tubular body. The outer shell is typically a rigid casing that attaches to the candelabra or other candle holder. The inner radius of the outer shell is typically larger than the candle. The inner shell is typically resilient and has a radius smaller than the candle. The inner shell includes a substantially cylindrical portion having a longitudinal axis. The inner shell further includes a number of prongs sharing a common longitudinal axis with the substantially cylindrical portion. The end of the outer shell that is adapted to connect to the candelabra is a closed end with a hole adapted to receive a screw, bolt or other device used to attached the support apparatus to the candelabra. The inner and outer shells are connected to each other by a connecting device such as a rivet that is typically driven through both the inner and outer shell perpendicular to the longitudinal axis.

In general, in one aspect, the inventions features a candle support apparatus including a first tubular body having a longitudinal axis and a hollow interior and a second tubular body having a common longitudinal axis with the first tubular body and a hollow interior, and positioned within a portion of the hollow interior.

In an implementation, the first and second tubular bodies have open ends and an end cap closing a substantial portion of an end of the first tubular body.

In another implementation, the second tubular body includes a substantially cylindrical base having a first end and second end and a common longitudinal axis with the first tubular body and a plurality of elongated prongs connected to one of the first and second ends of the base, and substantially parallel to the longitudinal axis.

In another implementation, the apparatus includes a connecting device that secures the first tubular body to the second tubular body, the connecting device being substantially perpendicular to the common longitudinal axes and protrudes into a portion of the hollow interiors.

In another aspect the invention features a candle control apparatus including a first substantially cylindrical body having an outer surface and an inner surface, and a first and second end, wherein at least one of the first and second ends is open, the first body having a first radius and a hollow interior, a second substantially cylindrical body having an outer surface and an inner surface, and a first and second end, wherein at least one of the first and second ends is open, the second body having a second radius less than the first radius and a longitudinal axis common to the first and second bodies, wherein the second body is positioned within a portion of the hollow interior of the first body.

In one implementation, the apparatus includes a connecting device that connects the first body to the second body.

In still another aspect the invention features a candle display apparatus including at least one candle, a candle display apparatus and a candle support apparatus connected to the candle display apparatus and adapted to receive and support the candle including a first tubular body having a longitudinal axis and a hollow interior and a second tubular body having a common longitudinal axis with the first tubular body, and positioned within a portion of the hollow interior.

In one implementation, the candle display apparatus is a candelabra or a candle stick.

In yet another aspect, the invention features a candle support apparatus including a rigid geometrically shaped body having a hollow interior with a first open end and a second substantially open end, a flexible geometrically shaped body having a hollow interior and a number of elongated prongs, and positioned within a portion of the hollow interior of the rigid body and a longitudinal axis common to the rigid body and the flexible body, wherein the flexible body is in a concentric arrangement with the rigid body.

In an implementation the apparatus includes a device that connects the rigid body to the flexible body.

In another implementation, the outer surface of the flexible body is in mechanical contact with the inner surface of the rigid body.

In another implementation, the outer surface of the flexible body is in a proximity of the inner surface of the rigid body.

In still another implementation, the elongated prongs are substantially parallel to the longitudinal axis.

In another aspect, the invention features a method of securing candles in a candle display including removing a present device used to support candles in the candle display, replacing the present device with a candle support apparatus, including a first tubular body having a longitudinal axis and a hollow interior and a second tubular body having a common longitudinal axis with the first tubular body, and positioned within a portion of the hollow interior.

One advantage of the invention is that it supports candles in candle display devices, providing a adjustment-free candle arrangement that does not interfere with ceremonies.

Another advantage of the invention is that it straightens the candle as it is inserted into the candle support apparatus, eliminating the need to manually adjust the candles.

Another advantage of the invention is that the prongs of the inner shell do not typically deform because they are supported by the rigid outer shell. In most cases, if the prongs do deform, the deformation typically does not interfere with the candle support because they are supported against the rigid outer shell.

Other objects, advantages and capabilities of the invention will become apparent from the following description taken in conjunction with the accompanying drawings showing the preferred embodiment of the invention.

DETAILED DESCRIPTION OF THE INVENTION

Figure 1A:
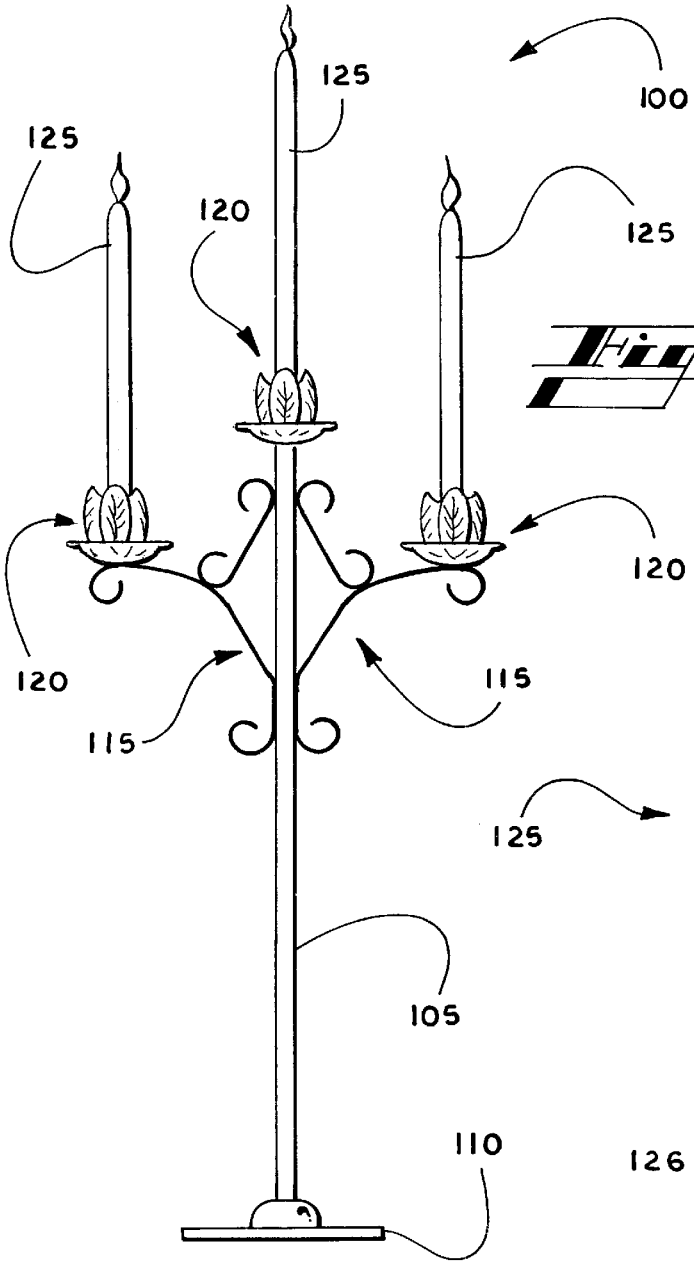
Fig 1A PRIOR ART
FIG. 1A illustrates a prior art mechanical candle candelabra.
Figure 1B:
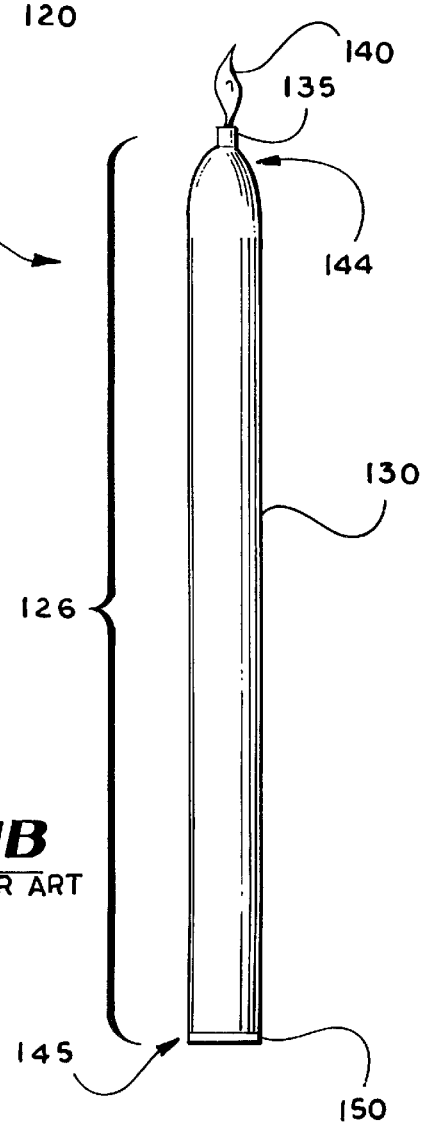
Fig 1B PRIOR ART
FIG. 1B illustrates a prior art mechanical candle.
Figure 2:
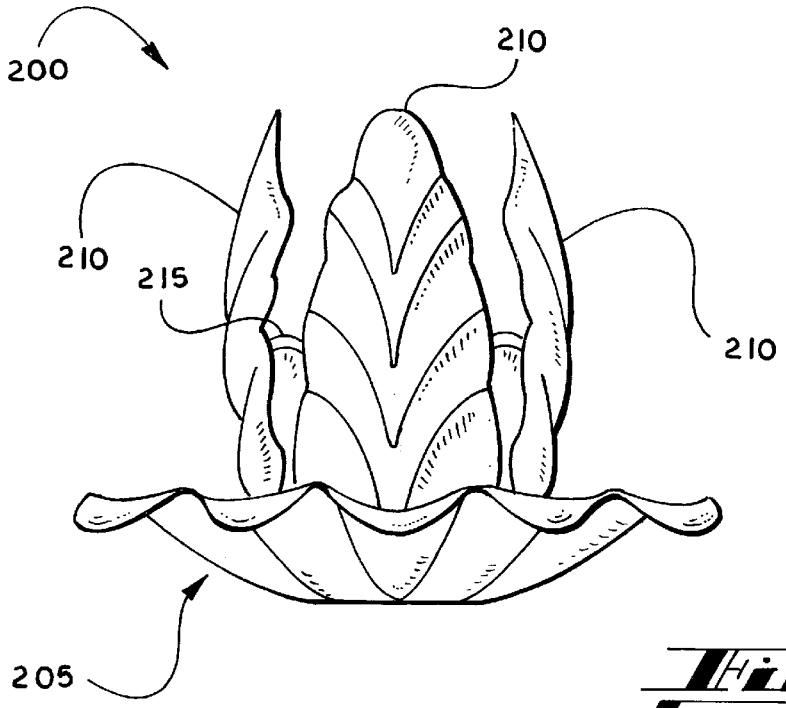
Fig 2 PRIOR ART
FIG. 2 illustrates a candle holder dish having prior art candle support prongs surrounded by decoration.
Figure 5:
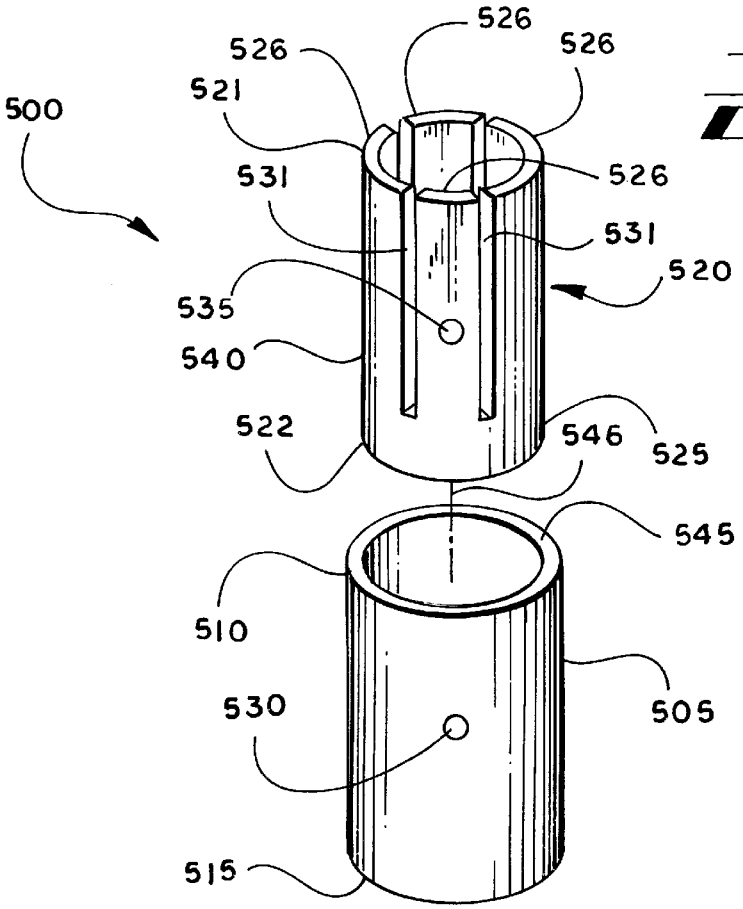
FIG. 5 illustrates two component parts of an embodiment of a candle support apparatus.
Figure 3C:
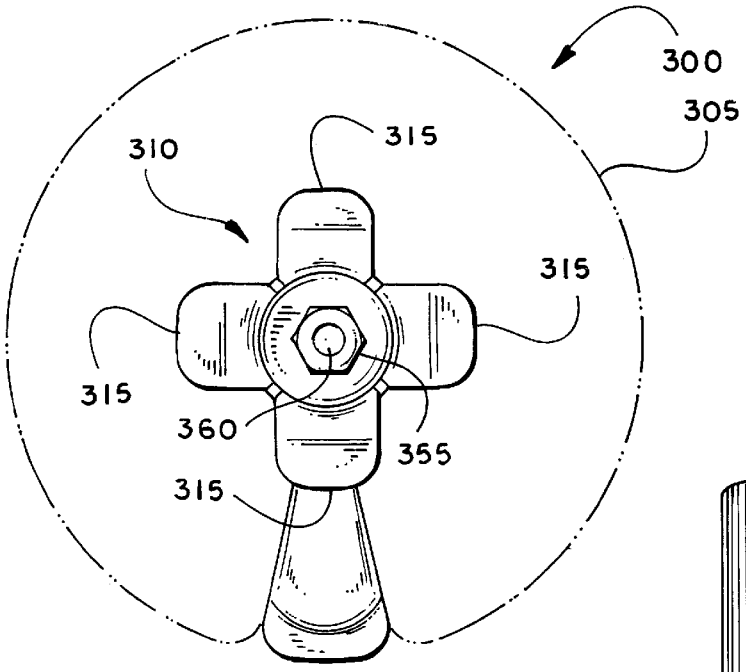
Fig 3C PRIOR ART
FIG. 3C illustrates atop view the candle dish of FIGS. 3A and 3B.
Figure 3A:
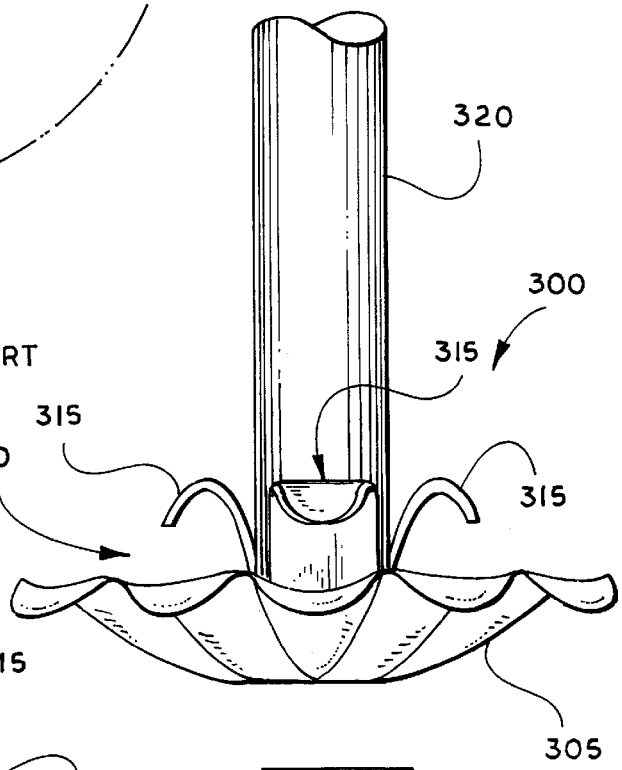
Fig 3A PRIOR ART
FIG. 3A illustrates a side view of a candle holder dish having prior art prongs supporting a mechanical candle.
Figure 3B:
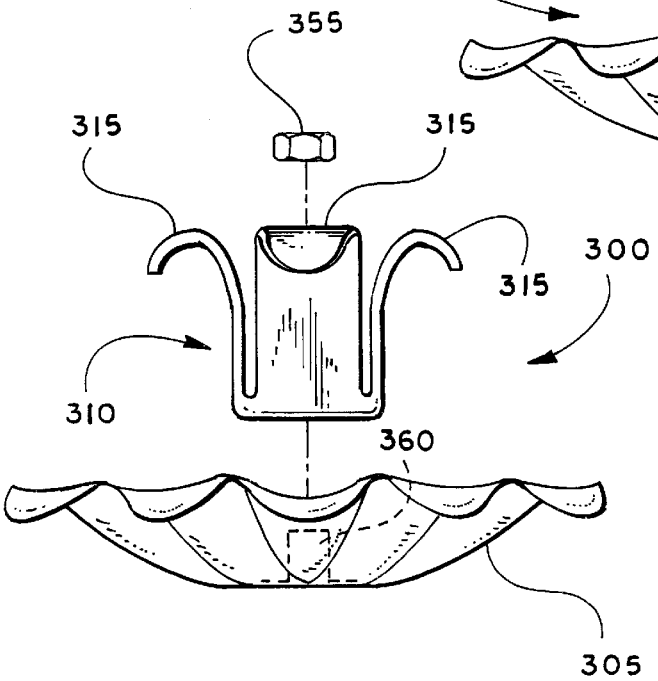
Fig 3B PRIOR ART
FIG. 3B illustrates the component parts of the candle dish of FIG. 3A.
Figure 4A:
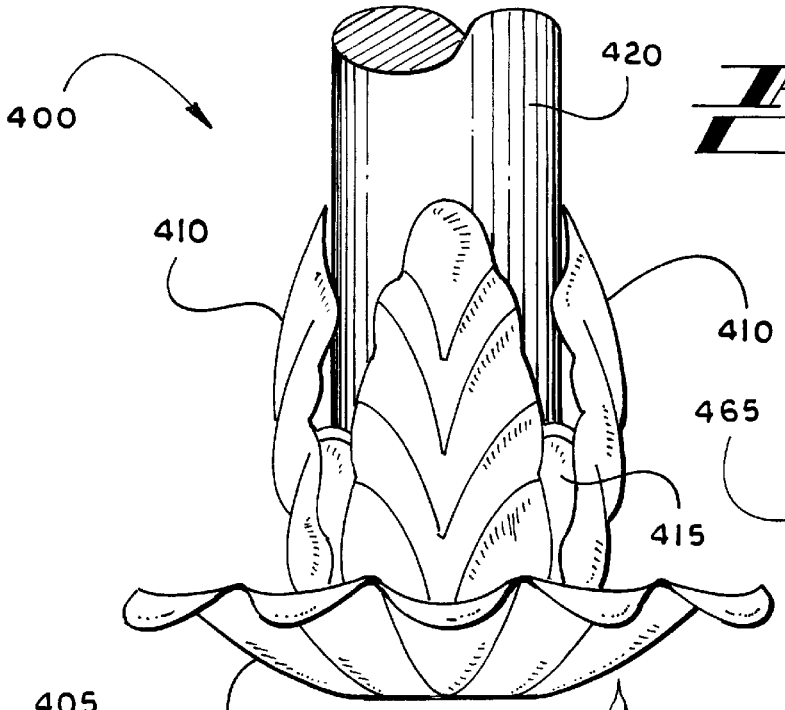
Fig 4A PRIOR ART
FIG. 4A illustrates a side view of a candle holder dish supporting a mechanical candle with prior art prongs.
Figure 4B:
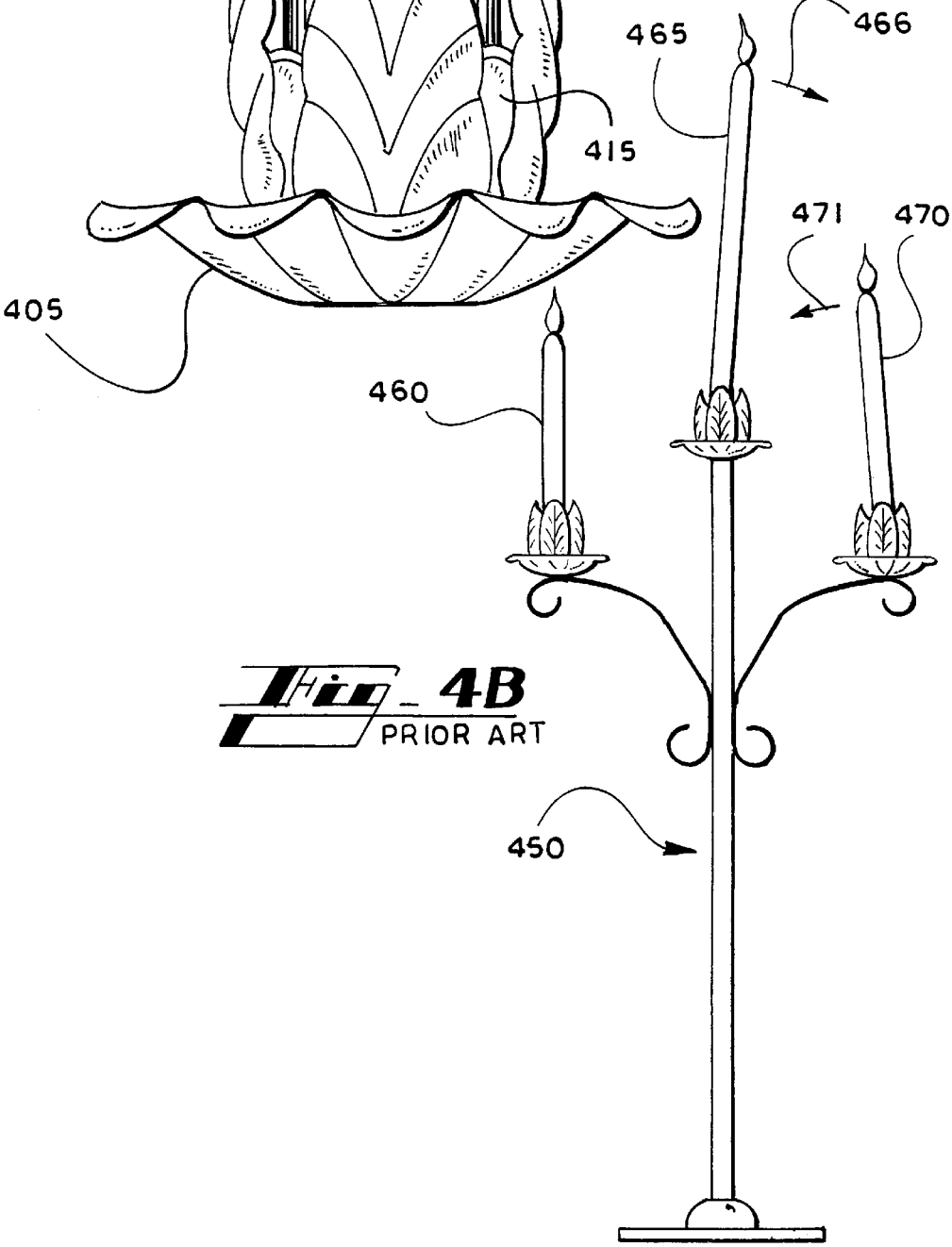
Fig 4B PRIOR ART
FIG. 4B illustrates a prior art mechanical candle candelabra.

Referring to the drawings wherein like reference numerals designate corresponding parts throughout the several figures, reference is made first to FIG. 5 illustrates the component parts of an embodiment of a candle support apparatus 500. The apparatus 500 includes an outer shell (or tubular body) 505 that a first end 510 and a second end 515. The outer shell is typically a cylindrical shape constructed to accommodate most mechanical candles. It is understood that the outer shell can be other shapes other than a cylinder. The first end is open in order to receive the base end of a mechanical candle (not shown). The second end 515 is typically closed but includes a hole (discussed below) in order to attach the apparatus 500 to a candelabra.

The apparatus also includes an inner shell (or tubular body) 520 having a first end 521 and a second end 522. Both the first end 521 and the second end 522 typically are open. The inner shell 520 includes a base portion 525 from which several support prongs 526 protrude. The inner shell is typically a cylindrical shape where its outer radius 540 is less than the inner radius 545 of the outer shell 505. The radius differential is necessary so that the inner shell can fit into the outer shell as indicated by arrow 546.

The inner shell is typically constructed by forming several cuttings 531 along the walls of the shell along the longitudinal axis of the shell. Therefore, the prongs 530 are typically integral pieces with the base 525. In another embodiment, several prongs can be connected to a cylindrical base to form the inner shell 520. In another embodiment, the inner shell can be formed by a preset mold or otherwise machined.

The inner shell 520 also includes an attachment hole 535 that lines up with another attachment hole 530 on the outer shell 505. When the inner shell 520 is inserted into the outer shell 505, the two attachment holes 530, 535 can be aligned so that the inner shell 520 and outer shell 505 can be secured to each other (discussed in further detail below).

Figure 6A:
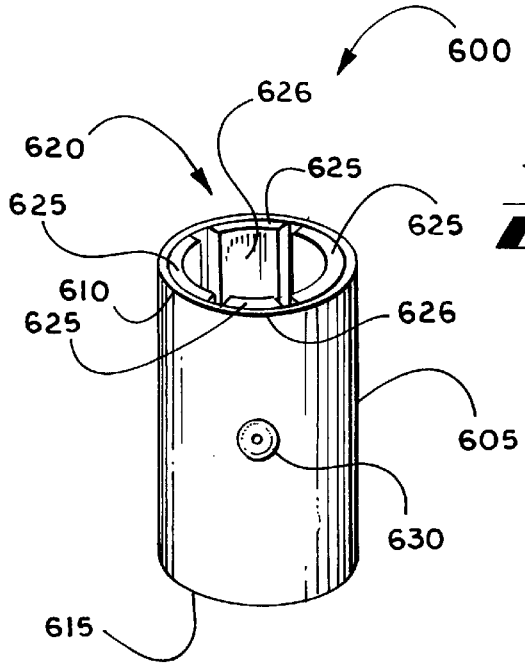
FIG. 6A illustrates a side view of an embodiment of a candle support apparatus.

FIG. 6A illustrates a side view of an embodiment of candle support apparatus 600. The support apparatus includes an outer shell 605 in which an inner shell 620 has been inserted. The outer walls of the prongs 625 of the inner shell 620 typically lay flush against the inner wall of the outer shell 605 or lay just off the inner wall of the outer shell 605. As seen in the figure, the two shells 605, 620 are substantially concentric. The outer ends 626 of he prongs 625 can be at the same position of the opening of the first end 610 of the outer shell 605 or recessed inside the opening or protrude from the opening. Typically the ends 626 either are located at the same position or slightly recessed into the interior of the outer shell 605.

Referring still to FIG. 6A, the inner shell 620 and outer shell 605 have been secured to each other by an attachment device 630. The attachment device 630 can be, but is not limited to a rivet, a screw, a nut and screw or bolt, a small cylindrical rod and the like. It is understood that the connecting device can be any suitable device that connects the outer shell 605 to the inner shell 620.

Figure 6B:
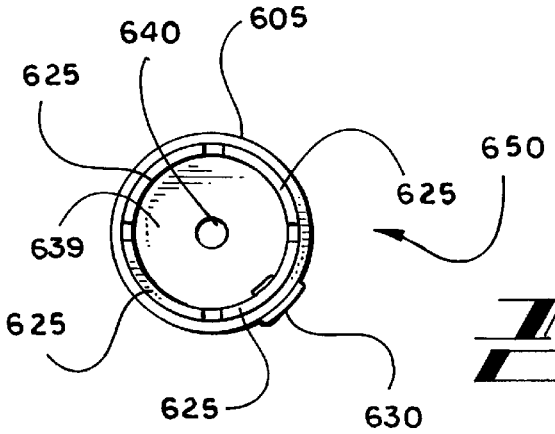
FIG. 6B illustrates a top view of the candle support apparatus of FIG. 6A.

FIG. 6B illustrates a top view 650 of the candle support apparatus 600 of FIG. 6A. As seen from the top view 650 the outer radius of the prongs is less than the inner radius of the outer shell 605. The attachment device 630 typically attaches the outer shell 605 with one of the prongs 625. In another embodiment, the attachment device 630 can connect the outer shell 605 to the base (525 in FIG. 5) of the inner shell 620. A hole 640 is located substantially in the middle of an end cap 639 attached to the second end 615 of the outer shell 605.

Figure 6C:
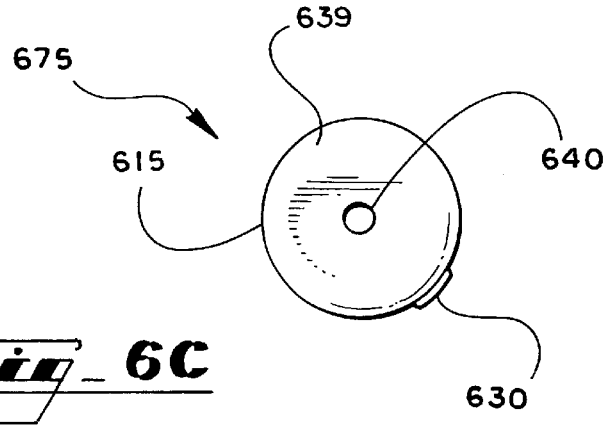
FIG. 6C illustrates a bottom view of the candle support apparatus of FIGS. 6A and 6B.

FIG. 6C illustrates a bottom view 675 of the candle support apparatus 600 of FIGS. 6A and 6B. As seen from the bottom view 675, the end cap 639 encloses a substantial portion of the second end 615 of the outer shell 605. The hole 640 provides an opening to attach the apparatus 600 to a candelabra. A portion of the attachment device 630 is also shown.

Figures 7A, 7B, 7C:
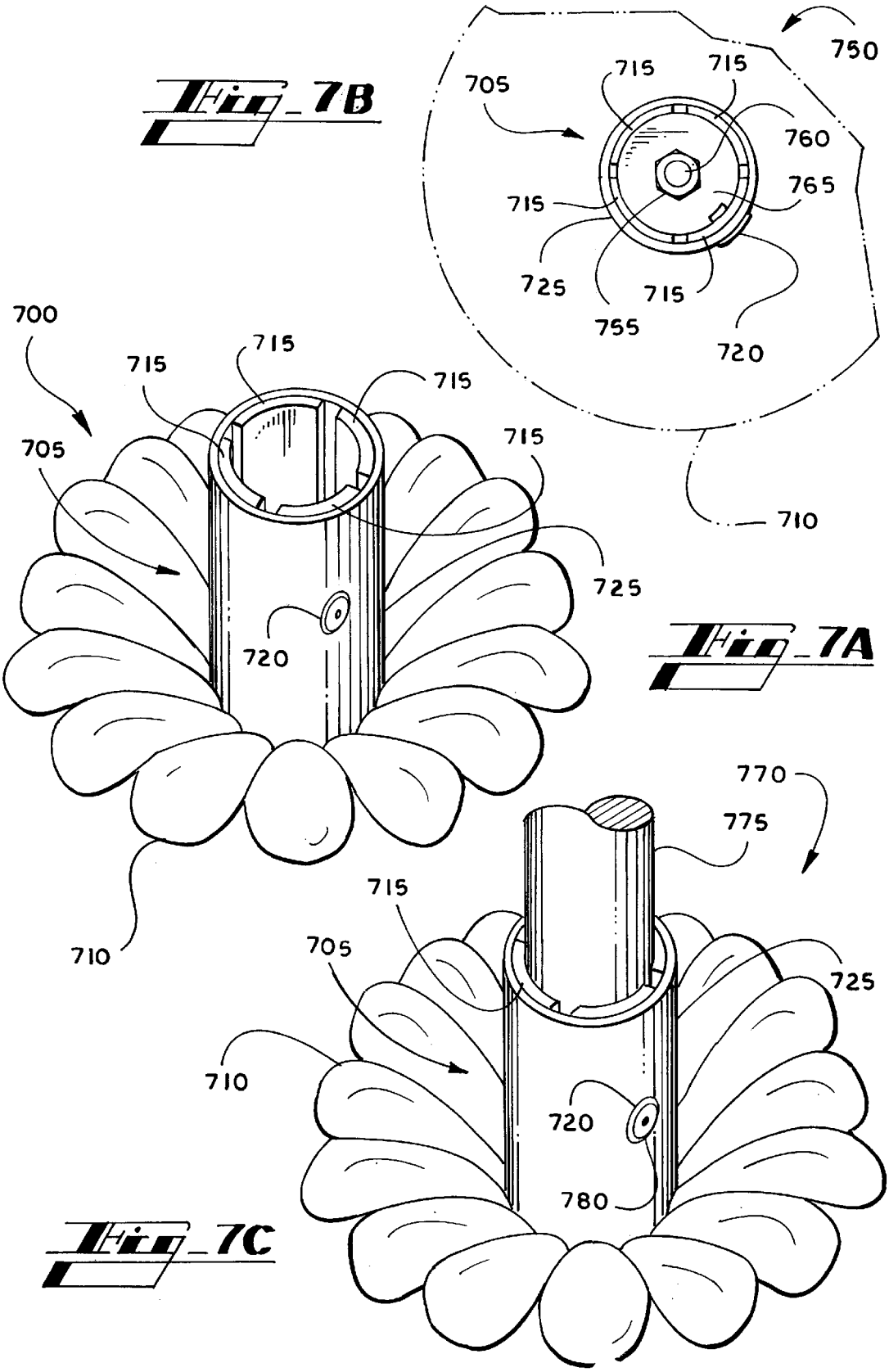
FIG. 7A illustrates a candle dish having an embodiment of a candle support apparatus.
FIG. 7B illustrates a top view of the candle dish of FIG. 7A.
FIG. 7C illustrates a side view of a candle dish having a candle support apparatus with a mechanical candle inserted into the apparatus.

FIG. 7A illustrates a side view 700 of a candle dish 705 having an embodiment of a candle support apparatus 710 attached to the dish 705. An outside portion of the attachment device 720 is shown. The device 720 connects the outer shell 725 to the inner shell. Portions of the prongs 715 of the inner shell are shown.

FIG. 7B illustrates a top view 750 of the candle dish 710 having an embodiment of a candle support apparatus 705 of FIG. 7A. The top opening of the apparatus 705 shows the top edges of the prongs 715 as well as the inner portion of the bottom end cap 765 of the apparatus 705. The figure further illustrates a top view of the nut 755 and the bolt 760 that connect the apparatus 705 to the candle dish 710. The connecting device 720 is shown attaching the outer shell 725 to one of the prongs 715.

FIG. 7C illustrates a side view 770 of a candle dish 710 having a candle support apparatus 705 with a mechanical candle 775 inserted into the apparatus 705. In an embodiment, the inner radius of the inner shell and the prongs 715 is less than the outer radius of the candle 775. This radius differential allows a tight fit between the candle 775 and the prongs 715 when the candle is inserted into the apparatus 705. As mentioned above there is also a radius differential between the outer radius of the inner shell and the inner radius of the outer shell 725. This radius differential typically results in the outer radius of the candle being less than the inner radius of the outer shell.

Still referring to FIG. 7C, as the candle 775 is inserted into the apparatus 705, since the outer radius of the candle 775 is larger than the inner radius of the inner shell, the candle 775 displaces the prongs 715 away from the candle 775 and toward the inner wall of the outer shell 725. In this way, the candle 775 becomes increasingly secured as it is inserted into the apparatus. Further security is attained simultaneously as the prongs 715 are pressed into the inner wall of the outer shell 725. As the base of the candle 775 moves closer to the base (525 in FIG. 5) of the inner shell the candle 775 ceases to move because the inner radius of the inner shell is less than the outer radius of the candle 775. The result is that the candle is securely fit into the apparatus. Furthermore, as the candle 775 is inserted into the apparatus 705, the longitudinal axis of the candle aligns itself with the longitudinal axis of the apparatus. With several candles in several candle support apparatuses in a candelabra, the result is securely fit straight candles that do not have to be straightened during candelabra operation.

Figure 7D:
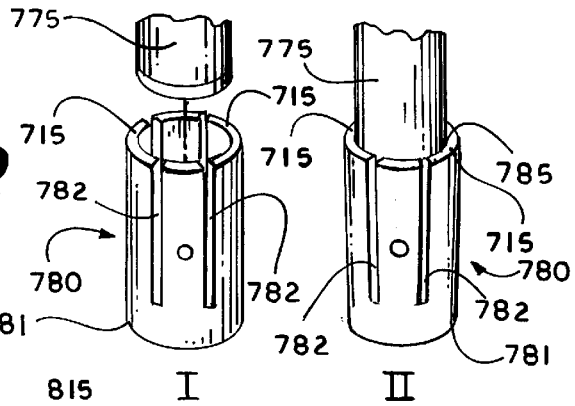
FIG. 7D illustrates an embodiment of an inner shell with and without a mechanical candle inserted into the shell.

FIG. 7D illustrates two states of an embodiment of an inner shell 780 with and without a mechanical candle 775 inserted into the shell 780. FIG. 7D is used to show the mechanical behavior of the inner shell 780 with the outer shell removed. In the first state I the mechanical candle 775 has not yet been inserted into the inner shell 780. The figure also illustrates that the radius of the candle 775 is larger than the outer radius of the shell 780. With the outer shell removed, the cuts 782 along the inner shell 780 and the full length of the prongs 715 are shown.

Still referring to FIG. 7D, state II illustrates the inner shell 780 as the candle 775 is inserted. Since the radius of the candle 775 is typically larger than the inner radius of the inner shell 780, the prongs 715 move outward and the cuts 782 widen. The prongs 715 continue to move outward and the cuts 782 continue to widen as the candle 775 moves toward the base 781 of the shell 780. As the candle 775 moves closer and closer to the base 781 the candle 775 becomes increasingly difficult to move because it cannot move past the inner radius of the base 781 due to the radius differential. With the candle 775 inserted into the shell 782 this manner, the candle 775 has no support and is able to rotate, twist and otherwise move in a variety of directions. This movement occurs because the candle is able to move into spaces 785 formed between the candle 775 and the prongs 715 as the candle 775 is inserted. Since the inner shell material is typically resilient and flexible, this movement occurs readily. However, with the addition of the rigid outer shell (as shown in FIG. 7C), the candle is supported. Referring again to FIG. 7C, the outer shell 725 inhibits the resilient movement of the prongs 715. This inhibition actually causes the candle to fit tighter and straighter. The more the candle 775 is inserted into the apparatus 705, the more the prongs 715 move outward and press against the outer shell 725. With further insertion, the candle becomes further supported and further straightened.

Referring again to FIG. 7B, the connecting device 720 is shown protruding into one of the prongs 715 past its inner wall. In this way, the connecting device partially blocks the path of the candle 775 as it is inserted into the apparatus 705. In this way the connecting device is a candle-stop so that the candle 775 cannot be inserted past the protrusion caused by the connecting device 720. FIG. 7C shows a line 780 which the candle 775 is not able to pass if the connecting device 720 protrudes inward. This candle-stop feature can be included in an embodiment of the apparatus 705. In another embodiment, the connecting device 720 does not interfere with the path of the candle 775. Therefore, the candle 775 is able to move past the line 780.

Figure 8A:
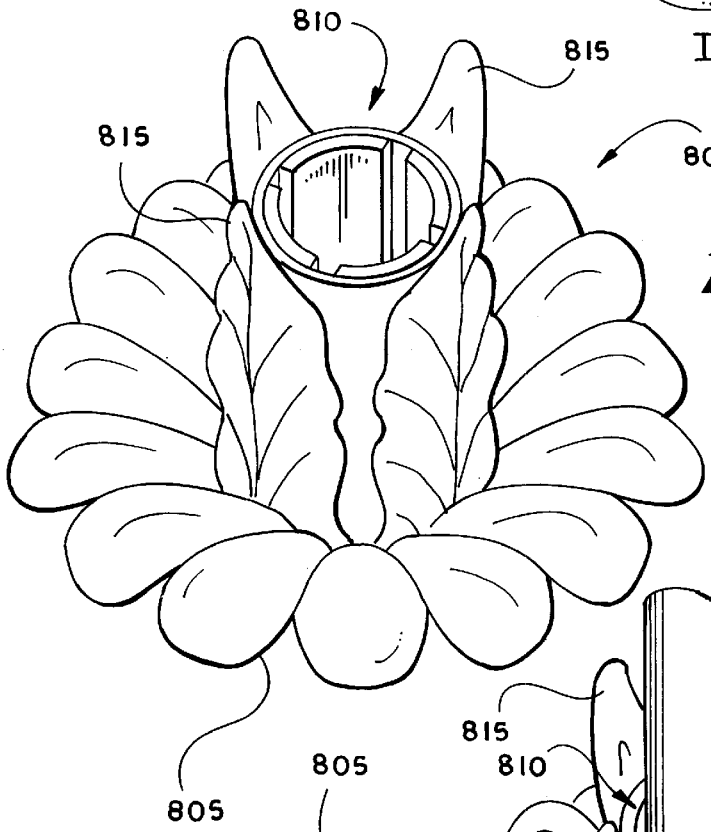
FIG. 8A illustrates a side view of a candle holder dish and an embodiment of a candle support apparatus surrounded by decoration.

FIG. 8A illustrates a side view 800 of a candle holder dish 805 and an embodiment of a candle support apparatus 810 surrounded by decoration 815. The decoration is typically decorative metal that conceals the apparatus 810.

Figure 8B:
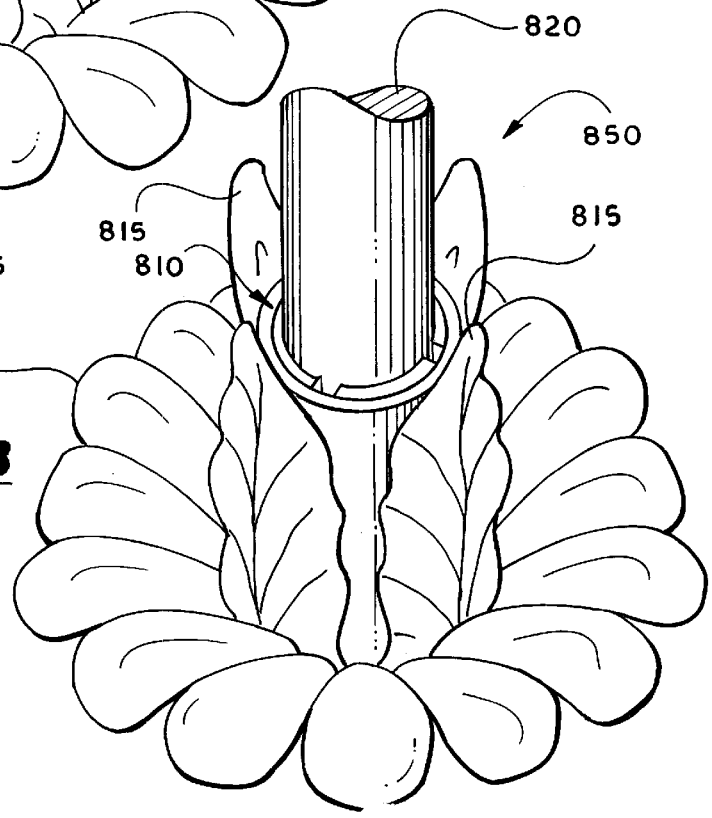
FIG. 8B illustrates a side view of a candle holder dish and an embodiment of a candle support apparatus surrounded by decoration and a candle inserted into the apparatus.

FIG. 8B illustrates a side view 850 of a candle holder dish 805 and an embodiment of a candle support apparatus 810 surrounded by decoration 815 and a candle 820 inserted into the apparatus 810.

A number of embodiments have been described. Nevertheless, is will be understood that various modifications may be made without departing from the spirit and scope of the invention. Several examples are now illustrated.

As way of illustration, the embodiments of the candle support apparatus have been described to support mechanical candles. The embodiments of the candle support apparatus can also support wax candles as well as candles comprised of other materials.

A candle support apparatus adapted to be affixed to candelabras have been described as the typical embodiment. However, any other candle display devices, such as candle sticks, can also be fitted with embodiments of the candle support apparatuses described above.

Several embodiments of the candle support apparatus have been described as a replacement piece for candelabras and other candle display devices. It is understood that the candle support apparatus can also be an integral part of any candle display device and can therefore be manufactured as part of the candle display device.

Other embodiments are within the scope of the following claims.

What is claimed is:

1. A candle support apparatus for replacing an old candle support device on a candle holder that includes nut and a bolt connecting the old candle support device to the candle holder, the apparatus comprising:

a first tubular body having a longitudinal axis and a hollow interior;

a second tubular body having a common longitudinal axis with the first tubular body and a hollow interior, the second tubular body being positioned within a portion of the hollow interior of the first tubular body;

a connecting device substantially perpendicular to the longitudinal axis and connected between the first and second tubular bodies, securing the first tubular body within the hollow interior of the second tubular body;

an end can connected to an end of the second tubular body, the end cap including a hole through which the bolt on the candle holder is fitted and connected to the bolt; and wherein the connecting device protrudes into a portion of the hollow interiors.

2. The apparatus as claimed in claim 1, wherein the second tubular body comprises:

a substantially cylindrical base having a first end and a second end and a common longitudinal axis with the first tubular body, and a plurality of elongated prongs connected to one of the first and second ends of the base, and substantially parallel to the longitudinal axis.

3. A candle display apparatus, comprising:

at least one candle;

a candle holder having a plurality of individual candle bases, each adapted to hold an individual candle control apparatus connected to the bases by a nut and bolt;

a candle control apparatus connected to each of the bases of the candle holder and each of the candle control apparatuses connected to a respective candle, each candle control apparatus comprising:

a first tubular body having a longitudinal axis and a hollow interior;

a second tubular body having a common longitudinal axis with the first tubular body and a hollow interior, and positioned within a portion of the hollow interior of the first tubular body;

a connecting device substantially perpendicular to the longitudinal axis, connecting the first tubular body within the hollow interior of the second tubular body, wherein the connecting device protrudes into a portion of the hollow interiors;

an end cap connected to an end of the second tubular body, the end cap including a hole through which the bolt on the candle holder is fitted and connected to the bolt; and wherein the first tubular body is connected to the respective base by the nut and the bolt in threaded engagement.

4. The apparatus as claimed in claim 3, wherein the candle display apparatus is a candelabra.

5. The apparatus as claimed in claim 3, wherein the candle display apparatus is a candle stick.

* * * * *